United States Patent [19]

Muller

[11] Patent Number: 4,469,448

[45] Date of Patent: Sep. 4, 1984

[54] SETTING MECHANISM FOR A WATCH

[75] Inventor: Jacques Muller, Reconvilier, Switzerland

[73] Assignee: E.T.A., S.A., Fabriques d'Ebauches, Switzerland

[21] Appl. No.: 312,670

[22] Filed: Oct. 19, 1981

[30] Foreign Application Priority Data

Oct. 23, 1980 [CH] Switzerland ..... 7891/80

[51] Int. Cl.[3] ..... G04B 27/02

[52] U.S. Cl. ..... 368/196; 368/197

[58] Field of Search ..... 368/196–199, 368/322, 323, 190

[56] References Cited

U.S. PATENT DOCUMENTS

| | | | |
|---|---|---|---|
| 857,667 | 6/1907 | Porter | 368/322 |
| 857,668 | 6/1907 | Porter | 368/322 |
| 1,087,525 | 2/1914 | Bannatyne | 368/196 |
| 3,797,226 | 3/1974 | Inoki et al. | 368/197 |
| 3,972,177 | 8/1976 | Vuilleumier | 368/196 |
| 4,112,673 | 9/1978 | Gilomen | 368/196 |

*Primary Examiner*—Bernard Roskoski

*Attorney, Agent, or Firm*—Allegretti, Newitt, Witcoff & McAndrews, Ltd.

[57] ABSTRACT

The time setting intermediate wheel 20 comprises both a wheel 20*a* which engages with the sliding crown wheel 8 when the crown wheel is slid in to the illustrated engaged position, and a pinion 20*b* which engages with a wheel of the watch gear train, for example the minute wheel 26*a* of the motionwork wheel 26.

3 Claims, 3 Drawing Figures

SETTING MECHANISM FOR A WATCH

BACKGROUND OF THE INVENTION

The present invention concerns a setting mechanism for a watch comprising a sliding crown wheel on a stem.

In a known mechanism of this type, a setting stem is movable with a translatory movement and actuates the crown wheel, which is mounted slideably on the stem, by means of levers such as a pull-out piece and a return bar. The sliding crown wheel can assume at least two positions, namely a neutral position and an active position in which it provides for transmission of the rotary movement of the stem to the gear train, for setting the watch to time. For that purpose, the sliding crown wheel is internally provided with a bore having flats, which is co-operable with flats provided on the stem. The crown teeth on its inner face engage with the gear train of the watch by way of an intermediate wheel which has to engage on the one hand with the teeth of the sliding crown wheel, which are of a particular cut, and on the other hand, with a wheel of the going train or motion work which is of normal cut. This results in a delicate compromise in regard to the cut of the intermediate wheel and irregular operation of the gear train when setting the watch to time.

Setting mechanisms are known which avoid this problem in that the crown wheel does not engage the intermediate wheel itself but clutches into engagement with a castle wheel in mesh with the intermediate wheel. Such known mechanisms are relatively complex.

BRIEF SUMMARY OF THE INVENTION

A first object of the invention is therefore to provide a simpler mechanism wherein the cut of the intermediate wheel is simplified.

A second object of the invention is to provide a mechanism in which transmission between the sliding crown wheel and the gear train takes place smoothly and under good kinematic conditions.

A third object of the invention is to provide such a mechanism wherein the cost of matching the components is reduced.

A fourth object of the invention is to provide such a mechanism wherein the external diameter of the sliding crown wheel is increased without a corresponding increase in the thickness of the watch movement.

According to the present invention, there is provided a setting mechanism for a watch comprising a plate, drive means, analog time display means, and a gear train, the mechanism comprising a stem slideable in the plate, a crown wheel which is mounted slideably but non-rotatably on the stem, means for communicating to the crown wheel, a sliding movement between a rest position and an engaged position in dependence on the sliding movement of the stem, an intermediate wheel which engages with one of the members of the gear train and the sliding crown wheel when the latter is in the engaged position, the intermediate wheel comprising a wheel for engaging with the sliding crown wheel and a pinion engaging with one of the wheels of the gear train, the wheel being disposed at a greater spacing from the axis of the stem than the pinion of the intermediate wheel.

BRIEF DESCRIPTION OF THE DRAWINGS

The invention will be described in more detail, by way of example, with reference to the accompanying drawings, in which.

DETAILED DESCRIPTION OF THE PREFERRED EMBODIMENT

Figure 1:
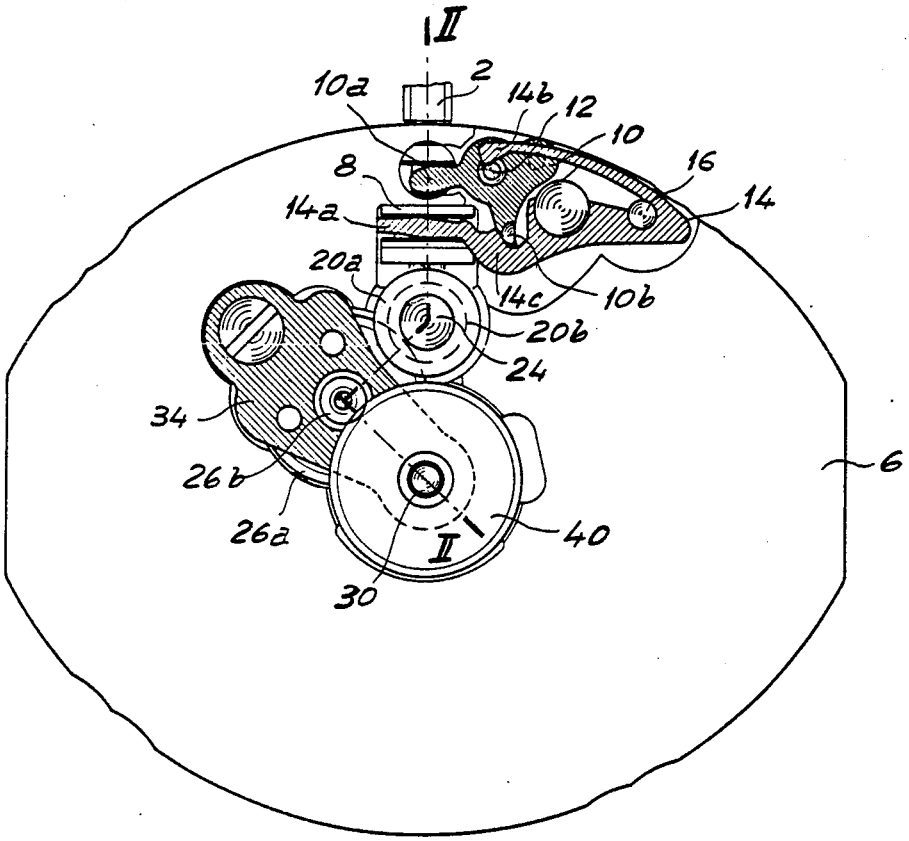
FIG. 1 is a plan view of a watch movement comprising an illustrative mechanism according to the invention.
Figure 2:
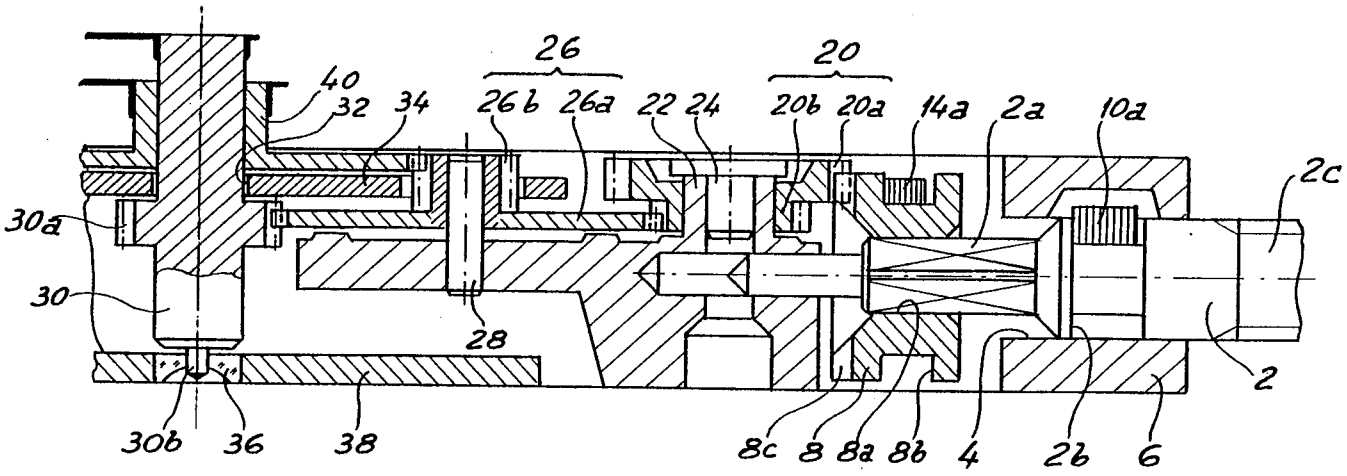
FIG. 2 is a view of part of the mechanism in vertical section taken along line II—II in FIG. 1.

FIGS. 1 and 2 show the assembly of the setting mechanism according to the invention, in the movement of the watch. As is well known, the setting mechanism comprises a stem 2 which is mounted slideably in a bore 4 in the plate 6 of the movement. The stem 2 has a portion 2*a* of square cross-section, which engages a square bore 8*a* in a sliding crown wheel 8 to key the latter to rotate with the stem.

The stem 2 is in an active position when it is pulled (position shown in FIG. 2) and it is inactive in the position in which it is pushed in. The stem communicates a reverse translatory movement to the sliding pinion 8 by way of two levers which can be more clearly seen from FIG. 1. The levers involved are respectively a pull-out piece 10 and a return bar 14.

The pull-out piece 10 is mounted pivotally on a stud 12. One end 10*a* of the lever is engaged in a groove 2*b* in the stem 2. The other end of the pull-out piece 10 is provided with a lug 10*b*. The return bar 14 is mounted pivotally about a stud 16. One arm 14*a* of the return bar is engaged in a groove 8*b* in the sliding crown wheel 8. The other arm 14*b* of the return bar lever 14 forms a spring which bears against the stud 12. A portion 14*c* of the return bar, which forms a cam surface, is engaged by the lug 10*b* of the pull-out piece. It will be clearly seen therefore that, by pulling the stem 2, the end 10*a* of the pull-out piece 10 is raised (in FIG. 1). In consequence, the lug 10*b* of the pull-out piece 10 causes the arm 14*a* of the return bar 14 to move downwardly and therefore causes downward movement of the sliding crown wheel 8 which moves into the active position.

On its inner face, opposite to the head 2*c* of the setting stem 2, the sliding crown wheel 8 has face teeth 8*c*. It is the face teeth 8*c* which will transmit the rotary movement of the stem to the motion work and therefore to the hands or other analog display means, for resetting the time on the watch.

As indicated above, transmission of the movement between the sliding crown wheel 8 and the motion work is by way of an intermediate wheel 20. The wheel 20 is preferably mounted pivotally on a hollow lug portion 22 which forms an integral part of the plate 6. The wheel is held in position by a pin 24 which is driven into the hollow lug portion 22. The wheel 20 comprises a wheel 20*a* and a pinion 20*b*, the pinion 20*b* being closer to the plate, that is to say, closer to the axis of sliding movement of the control stem 2. The wheel 20*a* engages with the teeth 8*c* of the sliding crown wheel when the latter is in the active position. The pinion 20*b* of the intermediate wheel 20 engages with the train of motion wheels.

In the particular example described herein, the motion work comprises a minute wheel 26 comprising a wheel 26*a* and a pinion 26*b*. The wheel 26 is mounted pivotally on a pivot post 28 driven into the plate 6. The wheel 26*a* engages with the pinion 20*b* of the intermediate wheel 20. The minute hand arbor 30 comprises a minute hand pinion 30*a* which engages with the wheel 26*a*. The arbor 30 is mounted pivotally in a bore 32 in an upper bridge piece 34. On the other hand, a pivot 30*b* of the arbor 30 is mounted in a bearing 36 fitted into a lower bridge piece 38. The hour hand is carried by the pipe of an hour wheel 40 which is journalled on the minute hand arbor 30. The wheel 40 engages with the pinion 26*b* of the minute wheel 26.

The drawings do not show the manner in which the motion work is driven. Indeed, it is clear that the setting mechanism according to the invention does not depend on the drive mode. The drive may be provided by any known means, e.g., a center wheel on the arbor 30 and driven via the going train by a motor or by the spring barrel, depending on whether the watch is an electronic watch or a mechanical watch. Such designs are well known to the man skilled in the art.

The mode of operation of the mechanism will follow clearly from the foregoing description. When the stem 2 is in its pushed-in position, the sliding crown wheel 8 is retracted. The minute wheel 26 is driven by the minute hand pinion 30*a* and the pinion 26*b* of the wheel 26 drives the hour hand wheel 40. This is the normal mode of operation. When the stem 2 is out, the sliding crown wheel 8 is pushed in. It therefore engages with the wheel 20*a* of the intermediate wheel 20. The pinion 20*b* is in engagement with the minute wheel 26, and rotary movement of the stem 2 is transmitted to the minute hand arbor 30 and hour hand wheel 40.

The advantages of the mechanism according to the invention will be apparent. Firstly, the wheel 20*a* engages only with the crown wheel 8, the connection to the intermediate wheel 26 being provided by the pinion 20*b*. It therefore is possible for the wheel 20*a* to have a tooth profile which is better adapted to the teeth 8*c* of the sliding crown wheel, since there is no need to take account of the teeth on the wheel 26. In addition, for a given thickness of the movement, the teeth of the intermediate wheel 20 which engage with the sliding crown wheel can be moved towards the upper face of the movement (towards the dial) without any need to modify the form of the intermediate wheel 26. The result of this is that the inside and outside diameters of the face tooth ring 8*a* on the crown wheel can be increased by the same amount. The ratio between the inside diameter and the outside diameter is also increased, which is favorable in regard to engagement of the crown wheel with the intermediate wheel. Due to the relative positions of the wheel and the pinion of the intermediate wheel, this improvement needs no increase of the thickness of the movement.

Figure 3:
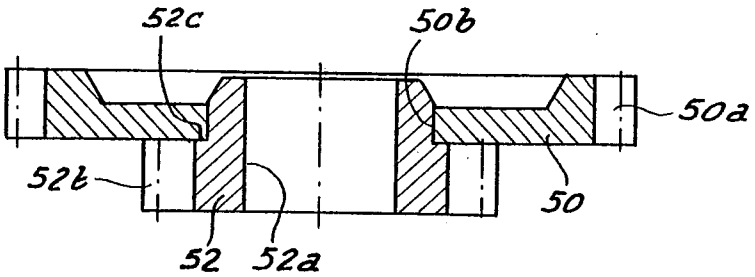
FIG. 3 is a detail view in vertical section of a preferred form of the intermediate wheel and pinion for transmission of movement between the sliding crown wheel and the motionwork train.

FIG. 3 shows a preferred embodiment of the intermediate wheel 20 which makes it possible to simplify machining thereof, and therefore to reduce the production cost thereof. In actual fact, the wheel 20 comprises a wheel 50 and a pinion 52 which are machined separately and then fixed together. The pinion 52 comprises a central bore 52*a* and peripheral teeth 52*b* over only a part of its height. Above the teeth 52*b*, the pinion has a shoulder 52*c*. The wheel 50 comprises peripheral teeth 50*a* and an axial bore 50*b*, the diameter of which is equal to the outside diameter of the pinion 52 at the level of the shoulder 52*c*. Driving the pinion 52 into the bore 50*b* in the wheel 50 makes it possible easily to produce a rigid, permanent connection between the wheel 50 and the pinion 52. It will be appreciated that any other form of connection between the wheel 50 and the pinion 52 could also be suitable, but would be likely to be more onerous.

It will be readily appreciated that separate machining of the wheel and the pinion is simpler than cutting a pinion and a wheel from a single blank.

It is apparent that modifications and changes may be made in the operation and structure of the invention as described above without departing from the scope of the invention. The description has been made only by way of example, and is not to be taken as limiting the invention.

What is claimed is:

1. In a watch comprising a setting mechanism, a plate, drive means, analog time display means, and a gear train, the mechanism comprising stem slideable in the plate, a crown wheel which is mounted slideably on and rotatably with the stem, means for communicating to the crown wheel a sliding movement between a rest position and an engaged position in dependence on the sliding movement of the stem, and an intermediate wheel which engages with one of the members of the gear train and the sliding crown wheel when the latter is in the engaged position, the intermediate wheel comprising a wheel for engaging with the sliding crown wheel and a pinion engaging with one of the wheels of the gear train, the wheel of the intermediate wheel being disposed at a greater spacing from the axis of the stem than the pinion of the intermediate wheel.

2. A setting mechanism arrangement according to claim 1 wherein the gear train comprises a motionwork minute wheel and the pinion of the intermediate wheel engages with the minute wheel.

3. A setting mechanism arrangement according to claim 1 or 2 wherein the intermediate wheel comprises a wheel having an axial bore and a pinion which has teeth only over a part of its height, the untoothed part of the pinion engaging into the axial bore in the wheel for being fixed with respect thereto.

* * * * *